United States Patent [19]

Ottsman et al.

[11] Patent Number: 4,899,681

[45] Date of Patent: Feb. 13, 1990

[54] BOAT MOORING DEVICE

[76] Inventors: Guy L. Ottsman, 10371 Surrey La., Redding, Calif. 96002; Dean R. Sherman, Sr., P.O. Box 413, Bella Vista, Calif. 96008

[21] Appl. No.: 227,674

[22] Filed: Aug. 3, 1988

[51] Int. Cl.[4] ..... B63B 21/00

[52] U.S. Cl. ..... 114/230

[58] Field of Search ..... 114/230, 293, 263, 219, 114/249, 250; 405/1, 224; 14/71.1; 280/459, 460.1, 406.1; 56/14.9, 15.4, 15.6, 15.8, 321

[56] References Cited

U.S. PATENT DOCUMENTS 2,387,352 10/1945 Radick ..... 114/230

2,938,492 5/1960 Kulick ..... 114/230

3,081,731 3/1963 McEvoy ..... 114/230

3,863,591 2/1975 Wild ..... 114/230

*Primary Examiner*—Joseph F. Peters, Jr.

*Assistant Examiner*—Jesus D. Sotelo

*Attorney, Agent, or Firm*—Leonard D. Schappert

[57] ABSTRACT

A boat mooring device is provided having a pair of adjustable-length arms positioned side by side and held in position by an adjustable-length cross member, each of the adjustable-length arms having a connector at one end to connect to a boat and a connector at the other end to connect to a shoreline. The boat mooring device may also include floats attached to the adjustable-length arms to keep the boat mooring device from sinking when it is detached from a boat.

5 Claims, 2 Drawing Sheets

BOAT MOORING DEVICE

BACKGROUND OF THE INVENTION

1. Field of the Invention

The present invention relates generally to devices for use in the mooring or docking of nautical vessels, and more particularly to a boat mooring device which extends between a boat and the shore to which it is to be moored and which has sufficient flexibility to allow the boat to float up and down with the water line, as well as to rock side-to-side, without damaging the boat or the mooring device.

2. Description of the Prior Art

The problems involved in securing small boats to shores and the like are well known in the art of mooring devices. One of the concerns is securing the boat to a shoreline while allowing for changes in the water level and turbulence which cause rocking of the boat with respect to the shoreline. Even though a boat is prevented from contacting the shoreline, if it is improperly secured to the shoreline, the boat may be damaged or lost, and if the mooring device for use with the boat is of insufficient width or length to provide for proper securing of the boat to the shoreline, the likelihood of damage and/or loss is considerably increased. The ease with which a boat can be removed from the mooring device and/or with which the mooring device can be removed from the shoreline is also important. While existing art has attempted to deal with these concerns by building mooring structures, none of the prior art of which applicants are aware has taught a boat mooring device having the unique features and capabilities of the present invention which allow it to be utilized with boats of different sizes and in a variety of situations, and which further allow the mooring device to be left at the shore of a lake or river while the boat is utilized so that the mooring device is still in position when the boat returns to the mooring area.

SUMMARY OF THE INVENTION

The present invention consists of a boat mooring device having a pair of arms held together and in position with respect to each other by a cross member. Each of the arms has a connector at one end which connects to a boat and a connector at the other end which enables the arm to be attached to a shoreline. Because of the materials utilized in the present invention and the adjustment capability of the arm structure as well as the cross member, the boat mooring device of the present invention may be utilized with boats of many different sizes and types and with different shoreline terrain, with resulting usefulness of the present invention much greater than has previously been experienced in the art of boat mooring devices. In one embodiment of the present invention, the boat mooring device includes two floats positioned near the end of the boat mooring device which is attached to a boat so that, when a boat is disconnected from the mooring device, the floats will keep it from sinking, thereby enabling a boat operator to reposition the boat properly and connect the boat mooring device to it upon returning to the mooring site.

One of the objects of the present invention is to provide a boat mooring device which includes a structure which extends between the shoreline and a boat.

Another object of the present invention is to provide a boat mooring device which has connecting means which facilitate attachment to a boat as well as attachment to the shore of a lake or river.

Another object of the present invention is to provide a boat mooring device which has adjustable-length arms which extend between a shore and a boat which facilitate use of the boat mooring device with boats of different sizes and under a variety of circumstances.

A further object of the present invention is to provide a boat mooring device having an adjustable cross member to which the arms are attached which facilitates adjustment of the relative position of the arms with respect to each other, thereby increasing the effectiveness and usefulness of the boat mooring device in a variety of circumstances and with a variety of boats of different sizes.

The foregoing objects, as well as other objects and benefits of the present invention, are made more apparent by the descriptions and claims which follow.

DESCRIPTION OF THE PREFERRED EMBODIMENT

Figure 1:
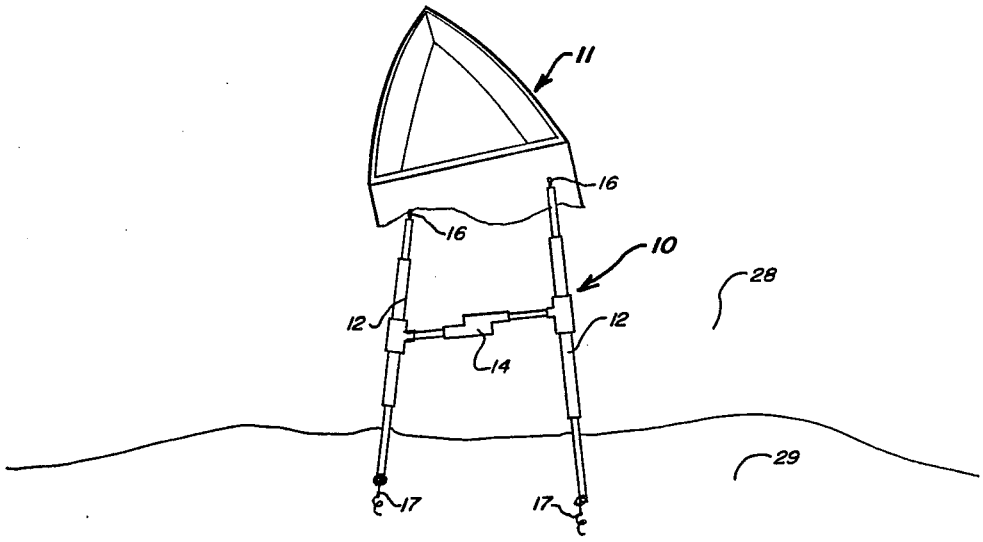
FIG. 1 is a perspective view of the boat mooring device of the present invention attached to a boat and to a shoreline showing the capability of the boat mooring device to allow the boat to rock back and forth with respect to the shoreline and to rise and fall with respect to the shoreline.

FIG. 1 of the drawings shows the boat mooring device 10 of the present invention in position between a boat 11 and the shoreline 29 and extending over water 28. Boat mooring device 10 is constructed of two adjustable-length arms 12 held in relative position with respect to each other by a cross member 14. Connectors 16 and 17 are provided to facilitate attachment of boat mooring device 10 to the back of a boat 11 and to shoreline 29 as shown. FIG. 1 also shows a boat 11 rocking side-to-side with respect to shoreline 29, exhibiting the capability of boat mooring device 10 of the present invention to flex sufficiently to allow boat 11 to move up and down with changes in water level or turbulence or varying weather, as well as to rock back and forth.

Figure 2:
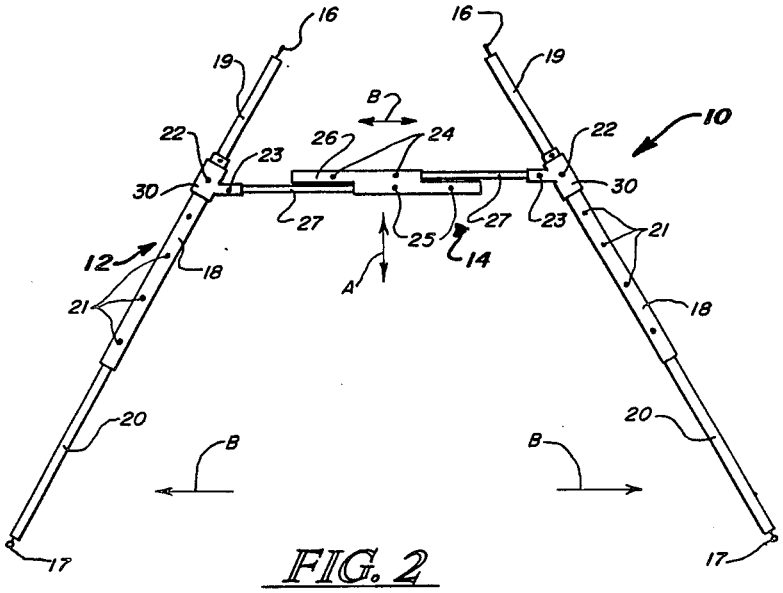
FIG. 2 is a top view of the boat mooring device of the present invention showing its construction.

FIG. 2 is a top view showing the structure and positioning of components of boat mooring device 10. Adjustable-length arms 12 each consist of hollow rod 18 the interior of which is sized and shaped to accept rods 19 and 20. Holes 21 are provided in hollow rods 18 with at least one hole being provided in each of rods 19 and 20 to facilitate attachment of rods 19 and 20 to hollow rod 18, and to provide an adjustment of the overall length of adjustable-length arm 12. Cross member 14 extends between the pair of adjustable-length arms 12. Cross member 14 consists of cross rod 26, which attaches to extension rods 27. Extension rods 27 in turn attach to tees 30. Tees 30 have attaching means which allow them to be attached to hollow rods 18, which in this particular embodiment consist of a hole extending through tees 30 so that they fit over hollow rod 18 and a hole 22 extending therethrough which allows them to be positioned and secured with respect to hollow rod 18. Extension rods 27 extend into cross rod 20 and are attached by means of pins which extend through holes 24 and 25. Extension rods 27 attach to tees 30 by means of pins which extend through holes 23 in tees 30 and holes in extension rods 27. The structure of cross member 14 is shown in greater detail in FIG. 9 of the drawings. For adjustment of boat mooring device 10 for proper shape and size to mate with boats of different shapes and sizes, the cross member 14 may be slid forward or backward as shown by arrow A to spread adjustable-length arms 12 farther apart or pull them closer together. Extension rods 27 can be adjusted with respect to cross rod 26 along arrows B to position adjustable-length arms 12 as desired. Because of the size of the holes in tees 30 through which hollow rods 18 extend, the angle of adjustable-length arms 12 with respect to each other is somewhat adjustable.

Figure 3:
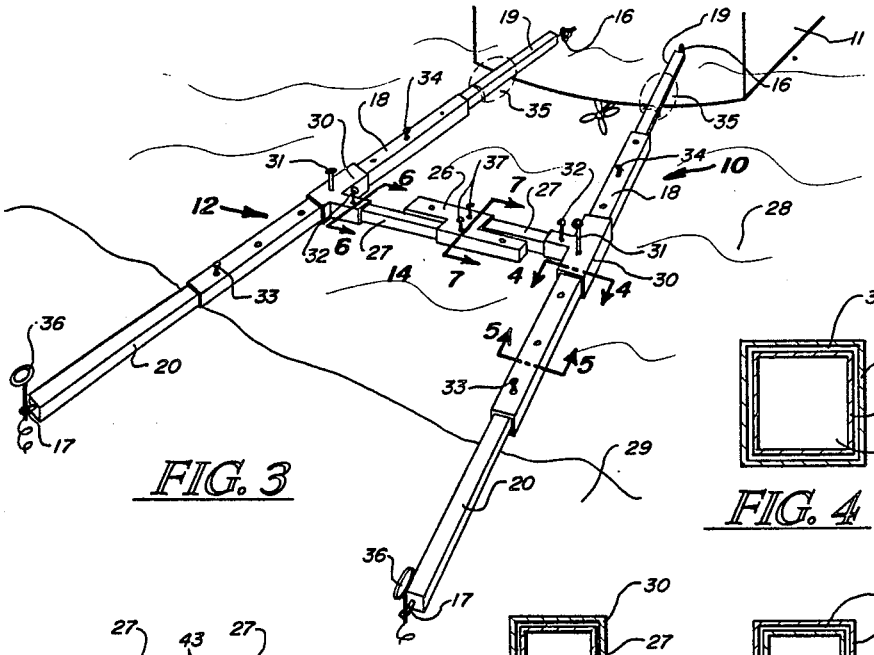
FIG. 3 is a perspective view illustrating the structure of the boat mooring device as positioned between a shoreline and a boat.

FIG. 3 of the drawings is a perspective view of boat mooring device 10 of the present invention which illustrates its adjustability and position during use. Rods 19 of adjustable-length arms 12 each have connectors 16 positioned thereon to facilitate attachment to boat 11 as shown. Flotation devices 35 constructed of an acceptable flotation material are provided and attach to adjustable-length arms 12 at or near rods 19 as shown to prevent boat mooring device 10 from sinking when it is detached from boat 11. Flotation devices 35 may be constructed of closed-cell flotation foam or the like. Rods 19 extend outward or inward with respect to hollow rod 18 to adjust the length of adjustable-length arms 12 and the position of boat 11 with respect to shoreline 29. A pin 34 is provided to securely position rod 19 with respect to hollow rod 18. Rods 20 also extend to adjust the length of adjustable-length arms 12 and are likewise positioned with respect to hollow rod 18 by being secured thereto by pin 33. Rods 20 each have a connector 17 at the end consisting of an eye or other effective means for attachment to shoreline 29. As an illustration of how the eyes of connector 17 may be utilized to attach to a shoreline, a twisted spike 36 is provided which is capable of screwing into the dirt at a shoreline. It extends through the eye of connectors 17 as shown. Tees 30 are held on hollow rods 18 of adjustable-length arms 12 by means of pins 31 as shown, and cross member 14 is held with respect to tees 30 by pins 32 as shown. Cross member 14 includes extension rods 27, which are held with respect to cross rod 26 by means of pins 37. The operator can change the length of cross member 14 by changing the placement of the holes in which pins 37 are placed.

Figure 4:
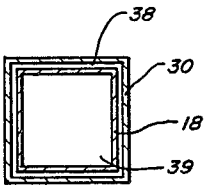
FIG. 4 is a cross-sectional view of a portion of the boat mooring device taken along lines 4—4 of FIG. 3.

FIG. 4 is a cross-sectional view taken along lines 4—4 of FIG. 3 showing the relationship of tee 30 to hollow rod 18. Tee 30 has a hole 38 through which hollow rod 18 extends, and hollow rod 18 has a hole 39 therein. Hole 38 is sized and shaped to accept hollow rod 18. While square hollow rod was utilized in this embodiment, a round hollow rod might as well be utilized. The size of hole 38 is sufficiently larger than the outer dimensions of hollow rod 18 so that, as boat 11 of FIG. 1 rocks as shown in FIG. 1, the difference in size between the outer dimension of hollow rod 18 and the size of hole 38 is sufficient to allow boat mooring device 10 of the present invention to flex without straining or breaking.

Figure 5:
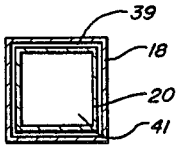
FIG. 5 is a cross-sectional view of a portion of the boat mooring device taken along lines 5—5 of FIG. 3.

FIG. 5 of the drawings is a cross-sectional view taken along lines 5—5 of FIG. 3. The size of hole 39 in hollow rod 18 is such that rod 20 fits therein. Rod 20 is here shown as being hollow, but a solid rod might also be utilized. Weight advantages are apparent with use of a hollow rod 20. The size of hole 39 in hollow rod 18 is sufficiently large so that rod 20 can flex and twist sufficiently with respect to hollow rod 18 to allow movement of boat 11 as shown in FIG. 1 without damage to boat mooring device 10.

Figure 6:
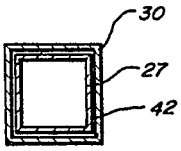
FIG. 6 is a cross-sectional view of a portion of the boat mooring device taken along lines 6—6 of FIG. 3.

FIG. 6 is a cross-sectional view taken along lines 6—6 of FIG. 3. Tee 30 has a hole 42 sized and shaped to fit extension rod 27. The size of extension rod 27 is slightly smaller than the size of hole 42 to allow boat mooring device 10 to flex, thereby minimizing the potential for damage to boat mooring device 10 as boat 11 rocks back and forth.

Figure 7:
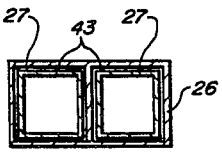
FIG. 7 is a cross-sectional view of a portion of the boat mooring device taken along lines 7—7 of FIG. 3.

FIG. 7 is a cross-sectional view of cross member 14 taken along lines 7—7 of FIG. 3 illustrating the construction of cross rod 26. Cross rod 26 has two holes 43 extending therethrough into which extension rods 27 extend. The size of hole 43 is sufficiently larger than the size of extension rods 27 to allow boat mooring device 10 to flex as shown in FIG. 1 of the drawings.

Figure 8:
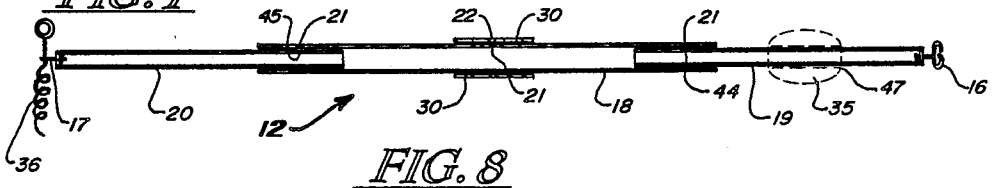
FIG. 8 is a cross-sectional view of one of the arms of the boat mooring device showing how the extension rods fit together to facilitate extension of the arms.

FIG. 8 of the drawings is a cross-sectional view of the full length of one of the adjustable-length arms 12 of boat mooring device 10. Rod 19 has hole 44, which may be aligned with any of holes 21 in hollow rod 18 to adjust the position of rod 19 with respect to hollow rod 18. Pin 34 of FIG. 3 is then inserted through one of holes 21 and hole 44 of rod 19. Tee 30 is hollow so that hollow rod 18 extends thereinto, and hole 22 of tee 30 may be aligned with any one of holes 21 of hollow rod 18 so that, by use of pin 31 of FIG. 3, tee 30 can be positioned securely with respect to hollow rod 18. Rod 20 has a hole 45 positioned therein which, when aligned with any one of holes 21 of hollow rod 18, may be secured by the use of a pin 33 as shown in FIG. 3. Connector 17, which is positioned at the end of rod 20, has an eye through which a connecting means is passed to facilitate attachment to a shoreline. In this particular embodiment, a twisted spike 36 such as that utilized in staking livestock to a particular area of a field may be utilized. A connector 16 is provided at the end of extension rod 19 and is capable of attaching to the eye piece that is normally positioned at the back of a boat. A flotation device 35 shown in dashed lines has a hole 47 through which rod 19 fits so that, when a boat is detached from boat mooring device 10, flotation device 35 holds adjustable-length arms 12 up until the boat 11 returns.

Figure 9:
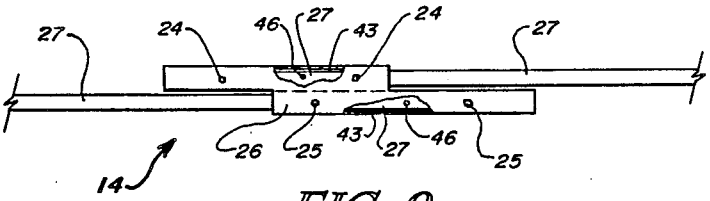
FIG. 9 is a top view of a portion of the cross member with appropriate cutaways showing its construction and the adjustability thereof.

FIG. 9 is a top view of a portion of cross member 14. Extension rods 27 fit into holes 43 of cross rod 26, and each of extension rods 27 has a hole 46 positioned therein so that, when extension rods 27 are properly positioned laterally inside of cross rod 26, hole 46 aligns with one of holes 24 or holes 25 so that the operator can position an individual extension rod 27 with respect to cross rod 26 by utilizing one of pins 37 of FIG. 3.

While the foregoing description of the present invention has shown a preferred embodiment using specific terms, such description is presented for illustrative purposes only. It is applicants' intention that changes and variations may be made without departure from the spirit or scope of the following claims, and this disclosure is not intended to limit applicants' protection in any way.

We claim:

1. A boat mooring device, comprising:

at least two arms, each of said arms having first attaching means for attachment to a boat, second attaching means for attachment to a shore, and an adjusting means whereby the length of said arm is adjustable to facilitate use with a variety of boats and in a variety of shoreline terrains, and an adjustable-length cross member extending between and attached to said arms whereby said arms are held in relative position with respect to each other.

2. A boat mooring device, comprising:

at least two arms, each of said arms having first attaching means for attachment to a boat and second attaching means for attachment to a shore, and an adjustable-length cross member extending between and attached to said arms by adjustable attaching means so that said adjustable-length cross member attaches to said arms at different relative positions with respect to said first and second attaching means while holding said arms in relative position with respect to each other.

3. A boat mooring device, comprising:

at least two arms, each of said arms having first attaching means for attachment to a boat and second attaching means for attachment to a shore;

flotation means attached to said boat mooring device near said first attaching means, and an adjustable-length rigid cross member extending between and attached to said arms whereby said arms are held in relative position with respect to each other.

4. The invention of claim 3, wherein said flotation means slide over said arms of said boat mooring device.

5. A boat mooring device, comprising:

at least two arms, each of said arms having first attaching means for attachment to a boat and second attaching means for attachment to a shore, and an adjustable-length rigid cross member extending between and attached to said arms by sufficiently loose attaching means so that said arms are held in relative position with respect to each other and said boat mooring device flexes as a boat attached thereto rocks from side to side.

* * * * *